US005121950A

United States Patent [19]

Davidian

[11] Patent Number: 5,121,950

[45] Date of Patent: Jun. 16, 1992

[54] HEAT ACTIVATED SPRING LOADED LOCKING BOLT FOR HINGED DOORS AND DOOR ASSEMBLIES EMPLOYING SAME

[75] Inventor: Richard M. Davidian, Kensington, Conn.

[73] Assignee: The Stanley Works, New Britain, Conn.

[21] Appl. No.: 690,523

[22] Filed: Apr. 23, 1991

[51] Int. Cl.[5] ..... E05B 17/20

[52] U.S. Cl. ..... 292/164; 292/DIG. 66; 292/340; 292/DIG. 65; 292/63; 292/92

[58] Field of Search ..... 292/DIG. 66, 163, 164, 292/1, 21, 92, 332, 300, 302, DIG. 65, 340, 63

[56] References Cited

U.S. PATENT DOCUMENTS

| | | | |
|---|---|---|---|
| 2,797,432 | 7/1957 | Gakle | 292/300 X |
| 3,325,941 | 6/1967 | Prucha | 47/7 |
| 3,705,739 | 12/1972 | Adler | 292/92 |
| 3,937,506 | 2/1976 | Dean | 292/300 |
| 4,012,066 | 3/1977 | Salvatore | 292/DIG. 66 X |
| 4,161,804 | 7/1979 | D'Hooge et al. | 16/48.5 |
| 4,183,565 | 1/1980 | Allemann | 292/163 |
| 4,635,729 | 1/1987 | Harmathy | 169/48 |
| 4,714,285 | 12/1987 | Langham | 292/163 |
| 4,726,613 | 2/1988 | Foshee | 292/167 |

FOREIGN PATENT DOCUMENTS

| | | | |
|---|---|---|---|
| 1549636 | 8/1979 | United Kingdom | 292/DIG. 66 |

*Primary Examiner*—Richard E. Moore

[57] ABSTRACT

A fire-retardant pivoted door assembly with fire activated latching members includes a metal door frame having jambs and a header in which a fire-retardant door is mounted by a hinge assembly with a lower temperature resistance that the door and frame. Fire actuated latch bolt assemblies in the door are spaced vertically along the hinge side of the door, and include a housing providing an elongated cavity opening at the edge of the door. A latch bolt is slidably seated in the cavity and is biased towards the opening of the cavity. A fusible closure extends across the opening of the cavity and retains the latch bolt against the biasing pressure, and the hinge jamb has a spaced recess formed therein to receive the latch bolt upon melting of the fusible closure.

19 Claims, 2 Drawing Sheets

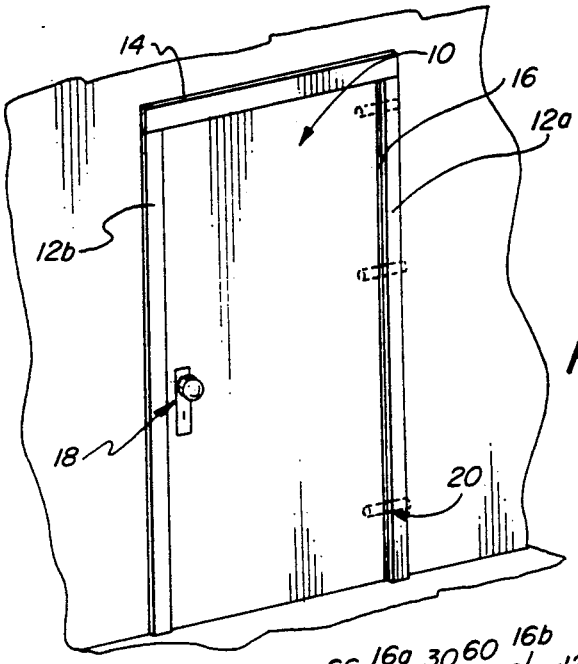
FIG. 1
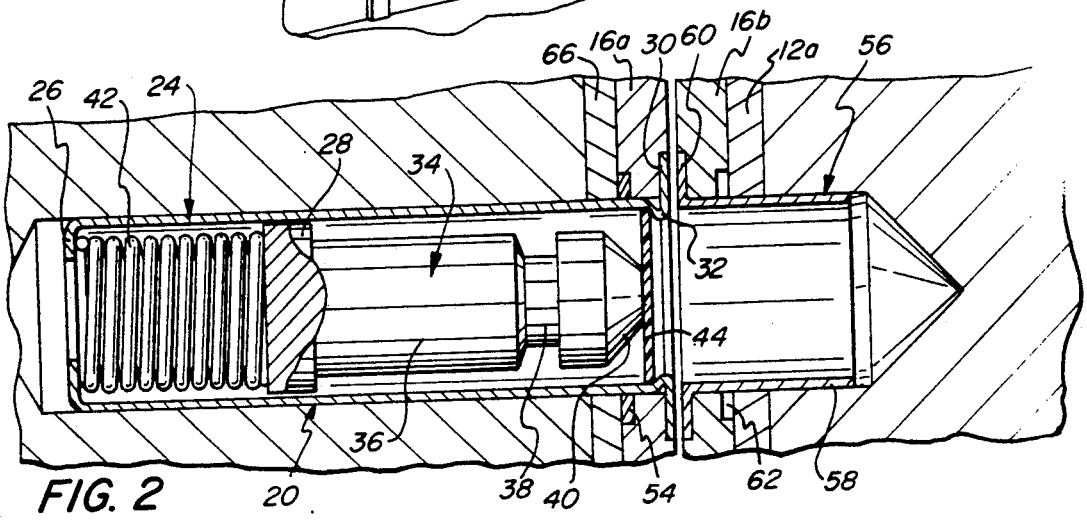
FIG. 2
FIG. 3
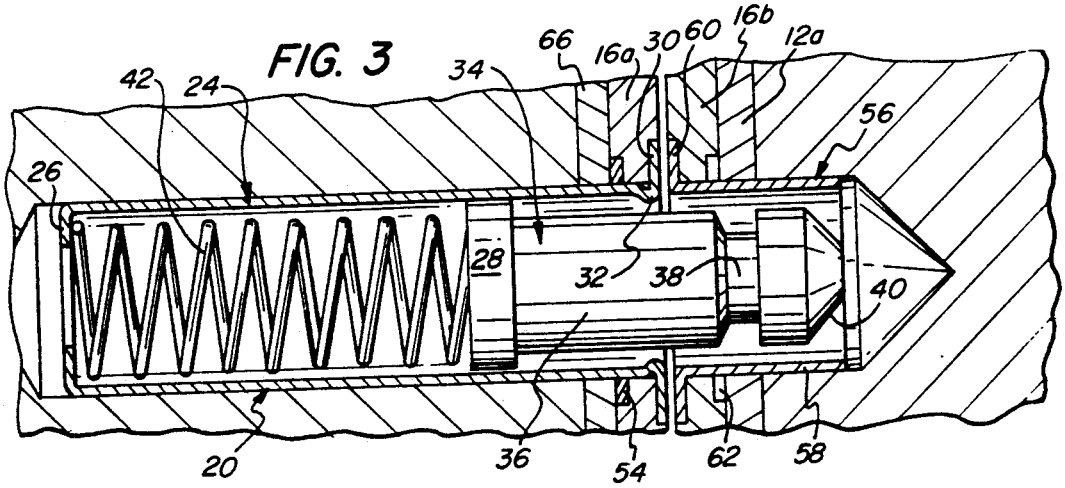

FIG. 4
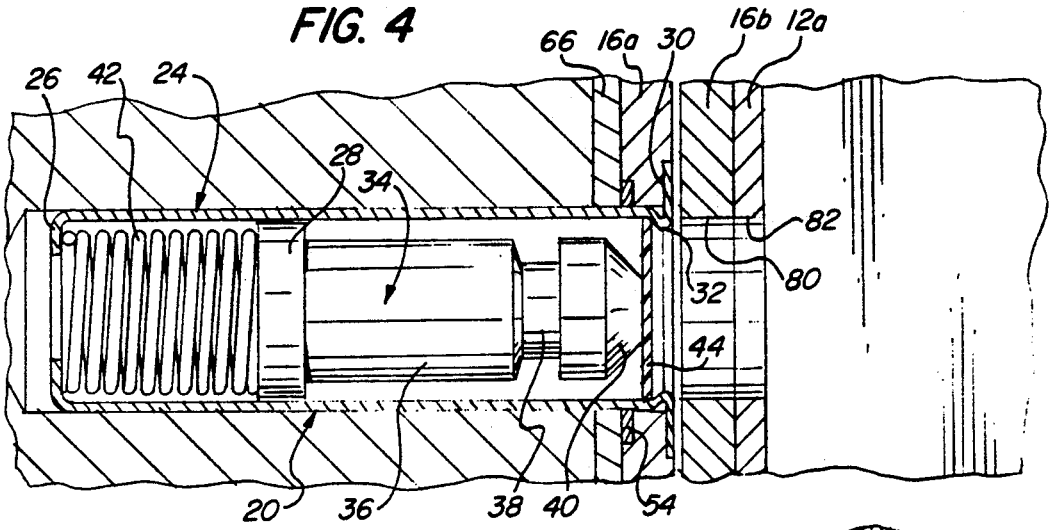
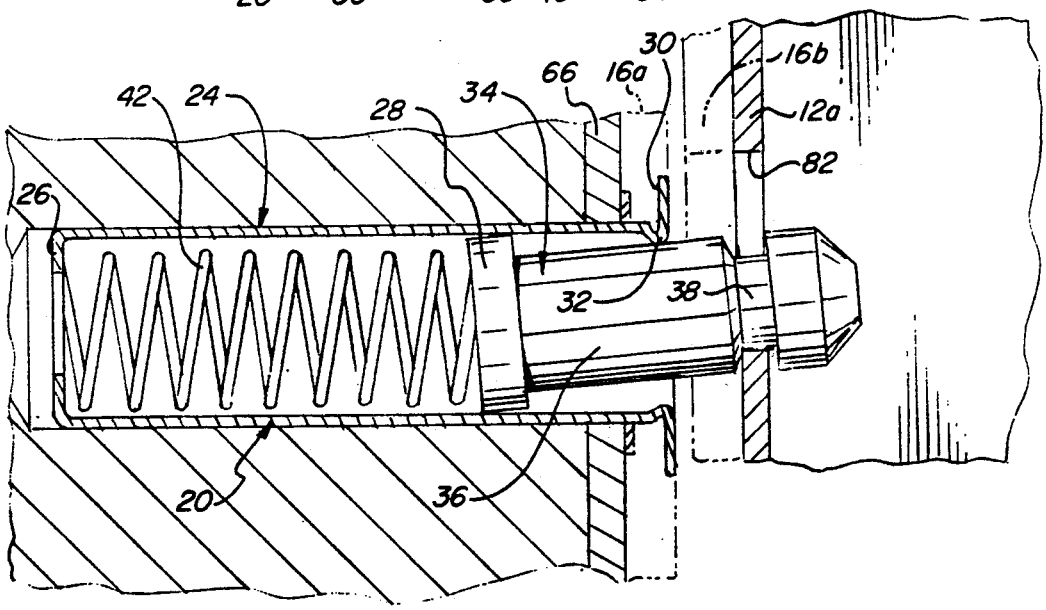
FIG. 5

HEAT ACTIVATED SPRING LOADED LOCKING BOLT FOR HINGED DOORS AND DOOR ASSEMBLIES EMPLOYING SAME

BACKGROUND OF THE INVENTION

The present invention relates to fire retarding door assemblies, and, more specifically, to fire actuated latch bolt assemblies for use in connection with doors to retain the door in the door opening.

As is well known, it is extremely desirable that fire retarding doors remain firmly within the door opening during fires in order to prevent the fire from rapidly spreading to other parts of the building and/or to limit the air to support combustion in a room in which there is an active fire. To achieve this result, many building codes require that doors in commercial buildings (and in some residential structures) have a fire resistance rating which will provide an effective fire barrier for a reasonable period of time. Thus, many doors for commercial buildings are fabricated with metal skins and frames, and others utilize fire-retardant materials which will provide a lesser degree of temperature resistance.

The door frames which are conventionally employed in fire-rated structures are generally comprised of metal jambs and headers. In fire-rated installations, it is necessary that the latch assembly utilized to secure the door in its closed position and the hinge assembly for mounting the door also have a fire rating sufficient to provide the desired protection to a specified temperature for a specified time.

As is known, metal-clad doors in which the skins are welded to metal stiles and headers, the heat of a fire may result in substantial warping pressures which can cause the hinges to distort or to disengage from the jamb or door. This could open the door passage to flames and air flow.

Recently, for cosmetic applications, there has been considerable interest in utilizing hinges made of aluminum and other metals which have lower fire resistance than the ferrous metals which are conventionally employed in fire-retardant door assemblies. This is particularly true of aluminum continuous hinges which extend over substantially the entire length of the hinge side of the door to provide a unique appearance and a high strength assembly under normal conditions.

Underwriters Laboratory and other safety agencies perform a fire test in which temperatures reach at the source approximately 2000° F. At this temperature, a continuous hinge made from aluminum would quickly melt since the melting temperature of most common aluminum alloys is 1200° F. Brass butt hinges start to melt at approximately 1600° F. Both of these types of hinges will distort at lower temperatures.

It is an object of the present invention to provide a novel fire-retarding door assembly employing fire-actuated latching devices which will serve to retain a door firmly within the door opening during a fire.

It is also an object to provide such a door assembly which will function to seal the door opening even if the hinge assembly loses its strength due to exposure to high temperatures.

Another object is to provide such an assembly in which the fire-actuated latching device may be readily fabricated and installed.

A further object is to provide such fire-actuated latching devices for use in fire-retarding door assemblies.

SUMMARY OF THE INVENTION

It has now been found that the foregoing and related objects may be readily attained in a fire-retardant pivoted door assembly which has a metal door frame having jambs and a header, and a fire-retardant door. A hinge assembly along one side of the door pivotally mounts the door on one of the jambs, and the hinge assembly has lower temperature resistance than the door and frame.

A multiplicity of fire actuated latch bolt assemblies in the door are seated in recesses spaced vertically along the hinged edge of the door, and each has a housing horizontally disposed in the door along its edge. This housing provides an elongated cavity opening adjacent the edge of the door, and a latch bolt is slidably seated in the cavity. Biasing means in the cavity biases the latch bolt towards the opening of the cavity and a fusible closure extends across the opening of the cavity to retain the latch bolt therein against the biasing pressure of the biasing means. The adjacent jamb has a spaced recess formed therein which is configured and dimensioned to receive the latch bolt upon release by melting of the fusible closure.

In the preferred embodiment, the latch bolt has a peripheral recess along its length and extending about its periphery, and, this recess is adapted and dimensioned to engage with the metal jamb upon its release into the recess therein. The housing has an inwardly extending lip adjacent the outer end of the cavity and the fusible closure is dimensioned and configured to be retained thereby. The housing also has an outwardly extending flange at its outer end.

Generally, the biasing means is a coiled compression spring, and the fusible closure is fabricated from a synthetic resin having a melting point of 180°–300° F. Desirably, the diameter of the latch bolt is 50–80 percent of the diameter of the recess in the jamb to allow limited relative motion therebetween upon release by the fusible closure, and the latch bolt projects into the recess of the jamb a distance of 0.15–0.75 inch depending upon the configuration of the bolt and the dimensioning of the bolt and jamb recess.

In one embodiment of installation, the hinge assembly is a continuous hinge extending along the vertical edge of the door with a pair of leaves having aligned apertures therein registering with the recesses in the door and jamb. The housing of the latch assembly has an outwardly extending flange at its outer end which seats in a counterbore in the hinge leaf. The latch bolt assembly may include a bolt receptacle having a tubular body seated in the recess of the jamb and dimensioned to receive the bolt.

BRIEF DESCRIPTION OF THE DRAWINGS

FIG. 1 is a fragmentary view of a wall having a fire retardant door installation embodying the present invention;

FIG. 2 is a fragmentary elevational view in partial cross section to a greatly enlarged scale of the hinge side of the door assembly of FIG. 1; and FIG. 3 is a fragmentary cross sectional view to an enlarged scale of the assembly seen in FIG. 2 after the latch device has been subjected to sufficient heat to cause the fusible disk to release the latch bolt; and FIG. 4 is a view similar to FIG. 2 wherein the latch device is mounted in a typical metal door frame installation which does not include a keeper; and FIG. 5 is a view of the installation of FIG. 4 with the hinge no longer shown and with the released bolt engaged with the metal wall of the jamb.

DETAILED DESCRIPTION OF PREFERRED EMBODIMENT OF THE INVENTION

Turning first to FIG. 1, therein can be seen a door assembly embodying the present invention. The door is generally designated by the numeral 10 and it is mounted within the door frame defined by the jambs 12 and header 14 by the continuous hinge 16 along its one side. On the opposite edge, the door 10 is secured in a closed position by a latch assembly generally designated by the numeral 18. Diagrammatically illustrated along the hinge side of the door 10 are a series of spaced latch assemblies generally designated by the numeral 20.

Turning next to FIG. 2, a latch assembly embodying the present invention is seen as having a housing generally designated by the numeral 24 of elongate generally tubular configuration with a rolled over inwardly extending flange 26 at its inner end providing a partial end wall and abutment surface. At its opposite end the housing 24 has a outwardly extending peripheral flange 30 and a collar 32 providing a reduced diameter for the housing 24 adjacent the flange 30.

Slidably seated within the cavity defined by the housing 24 is a latch bolt generally designated by the numeral 34 having an elongated cylindrical body 36 with a circumferential recess 38 adjacent its outer end and a generally frustroconical tip 40 at its outer end. At the opposite end, the bolt 34 has an enlarged collar 28 which closely approximates the inside diameter of the housing 24 so as to provide guidance for the latch bolt 34 as it moves within the housing 24. Seated on the end wall or inturned lip 26 at the inner end of the housing 24 is a coiled compression spring 42 which biases the latch bolt 34 towards the opposite end of the housing 24.

Trapped by the collar 32 at the outer end of the housing 24 is a fusible disk 44 against which the tip 40 of the latch bolt 34 abuts and which serves to retain the latch bolt 34 within the housing 24 against the biasing pressure of the spring 42.

The door 10 is provided with a recess in the hinge stile and the hinge leaf **16*a* and metal skin 66 of the door have a passage extending therethrough in which the housing 24 is seated. The hinge leaf 16*a* has counterbores in both surfaces about the passage therethrough, and the flange 30 is seated in the outer counterbore so as to be flush with the surface of the hinge leaf 16*a*. The housing 24 is retained in assembly with the hinge leaf 16*a* by the locking ring 54** which seats in the inner counterbore.

In accordance with one embodiment of the present invention, a keeper generally designated by the numeral 56 is provided to cooperate with the latch device 20. The keeper 56 comprises a cylindrical housing 58 with an outwardly extending flange 60 seated in a counterbore in the outer face of the hinge leaf **16*b* with the body of the housing 58 extending into a recess formed in the hinge jamb 12*a*. As in the case of the latch device 20, the keeper is assembled to the hinge leaf 16*b* by the locking ring 62 which is seated in the counterbore in the inside surface of the hinge leaf 16*b***.

Turning now to FIG. 3, therein diagrammatically shown is the assembly of FIG. 3 after the fusible disk 44 has melted and the latch bolt 34 has been projected by the spring 42 into the keeper 56. Although there is some play permitted between the latch bolt 34 and the keeper 56, the latch bolt will retain the door 10 in assembly with the hinge jamb **12*b* even if the hinge 16** should distort or melt.

In FIG. 4 diagrammatically shown is a view of a typical metal door frame installation which does not utilize the keeper shown in FIGS. 2 and 3. In such an installation, it is only necessary to drill a hole 80 through the hinge leaf and a hole 82 in the metal skin or face of the door jamb **12*a***.

Turning now to FIG. 5, a disaster condition is shown therein wherein the metal hinge has melted (as shown by phontom line), and the lock bolt 34 has been released to move into the hole 82 drilled into the metal jamb **12*a* and into the cavity therebehind. As can be seen, the groove 38 in the bolt 34 is aligned with the metal skin of the jamb 12*a* and dropping of the door 10 within the metal door frame has brought the groove 38 into contact with the metal skin of the door jamb 12*a*** and produced the engagement illustrated in this figure.

The present invention is applicable not only to metal doors, but also to doors of treated wood and doors with temperature resistant plastic skins which will meet less stringent criteria for fire retardance. Generally, however, it will have its greatest application to metal-clad doors of the type having metallic framework elements and insulating cores to provide a relatively high fire rating.

To assemble the fire-actuated latch, a hole is drilled into the edge of the door and the stile or framing element for a distance sufficient to seat the latch housing therewithin. When a continuous hinge is being employed, the hole will be drilled through the leaf of the hinge and then through the skin of the door and into the stile.

For flush mounting, an enlarged counterbore is provided about the housing receiving bore in the edge of the door or hinge in order to seat the outwardly extending flange. When the latch is to be preassembled to the hinge, the opposite surface of the hinge may also be counterbored to seat a locking ring to effect secure engagement with the hinge and support of the latch housing during the mounting of the hinge.

When the latch is to be mounted in the edge of the door in spaced relationship to butt or like hinges, a small amount of adhesive or sealant may be utilized to maintain the housing in position, or the tolerances may be such that the flange is press fit into a counterbored recess in the door. If so desired, the flange may be enlarged to provide for fasteners to secure the housing to the door.

A recess or bore must be provided in the hinge jamb to seat the latch bolt when released, and the depth of this bore must be such that it will permit the latch bolt to freely extend thereinto. Although not necessary, the preferred assemblies utilize a receptacle or keeper to receive the latch bolt, and the keeper may have a peripheral flange at its other end. If so, a counterbore will normally be provided in the face of the jamb or the face of the continuous hinge or other hinge through which the latch bolt receiving bore extends in order to seat the peripheral flange of the keeper housing. When preassembled to the hinge, it is similarly desirable to provide a counterbore on the opposite surface of the hinge to seat a locking ring.

The size of the latches may vary depending upon the thickness of the door and the number of latch assemblies to be employed. Desirably, the latch bolt when released should project from its housing a distance of ¼–1 inch to ensure firm engagement within the bore formed in the door jamb. Since it is desirable to minimize the impact of the latches upon the appearance of the door assembly, it will normally be sufficient to provide latches employing a housing of about 1.4–2.0 inches in length, and 0.4–1.0 inch in diameter. The bolt desirably has a diameter at its projecting portion of 0.33–0.75 inch to ensure adequate structural strength while minimizing the size of the housing. The amount of projection into the jamb recess should be on the order of 0.15–0.75 inch depending upon the configuration and the dimensioning of the bolt and jamb recess.

The aperture in the receiving recess or keeper desirably provides clearance about the latch to ensure that the latch bolt will be received therein even if there is some warpage or misalignment of the door. Generally, the receiving recess should have a diameter which is 1.25 to 1.50 times the diameter of the body of the latch bolt received therein. Moreover, to facilitate entry of the latch bolt into the receiving recess, the bolt desirably has a conical tip.

To guide the latch bolt within its housing, it is desirably provided with an enlarged collar which will closely, but slidably, seat against the inside surface of the housing. In the preferred structures, a groove is provided about the latch bolt and spaced from the tip of the bolt a distance calculated to align with the jamb in which it will be received.

As will be appreciated, the latch bolt housing and spring should be fabricated from metal of relatively high melting point to provide a desirable degree of temperature resistance, and the spring should be heat treated under appropriate conditions to maintain its biasing action at the rated temperature. Steel alloys are desirably used for the components and will generally survive the Underwriters Laboratory fire test of three hours at 2000° F. In the illustrated embodiment, a tubular housing has had its inner end rolled over to provide a inturned lip functioning as a partial end wall. However, the housing may also be integrally formed with an end wall, or a separate disk, washer, or other similar element may be seated against an inturned flange to provide a complete end wall.

In the illustrated embodiment, the spring bears against the flat inner end surface of the enlarged collar on the bolt. However, the inner end of the bolt also may be formed with a recess in which the spring seats.

The fusible closure is desirably fabricated from a synthetic resin which will melt at a temperature of 180°–300° Fahrenheit, and preferably 200°–250°. Suitable resins include polypropylyene, polyethylene, acrylonitrile/buadiene/styrene terpolymer. The thickness may vary, which will increase or decrease the time for it to lose its integrity at a temperature above its melting point. As used herein, "fusible" and "melting" are intended to encompass melting, volatilizations, and rupturing as a result of the loss of strength under the exposure to elevated temperatures.

Thus, it can be seen from the foregoing detailed description and attached drawings that the fire actuated latching devices employed in the door assemblies of the present invention will retain a door firmly within the door opening at elevated temperatures which might produce warping of the door or failure of the hinges. The latching devices may be readily fabricated and installed, and are adapted for use with both butt hinges and continuous hinges.

Having thus described the invention, what is claimed is:

1. A fire-retardant pivoted door assembly with heat actuated latching members comprising:
   (a) a metal door frame having jambs and a header;
   (b) a fire-retardant door;
   (c) a hinge assembly along one side of said door pivotally mounting said door on one of said jambs, said hinge assembly having a lower temperature resistance than said door and frame; and
   (d) a multiplicity of heat actuated latch bolt assemblies seated in recesses in said door spaced vertically along said one jamb, each of said assemblies including:
      (i) a housing horizontally disposed in said door along its edge on said one side, said housing providing an elongated cavity opening adjacent the edge of said door;
      (ii) a latch bolt slidably seated in said cavity;
      (iii) means biasing said latch bolt towards the opening of said cavity; and
      (iv) a fusible closure extending across said opening of said cavity and retaining said latch bolt therein against the biasing pressure of said biasing means, said one jamb having a spaced recess formed therein configured and dimensioned to receive said latch bolt upon release by melting of said fusible closure.

2. The pivoted door assembly in accordance with claim 1 wherein said latch bolt has a circumferential recess along its length and dimensioned to be engageable with said metal jamb upon its release into said recess therein.

3. The pivoted door assembly in accordance with claim 1 wherein said housing has an inwardly extending lip adjacent the outer end of said cavity and said fusible closure is dimensioned and configured to be retained thereby.

4. The pivoted door assembly in accordance with claim 1 wherein said housing has an outwardly extending flange at its outer end.

5. The pivoted door assembly in accordance with claim 1 wherein said biasing means is a coiled compression spring.

6. The pivoted door assembly in accordance with claim 1 wherein said fusible closure is fabricated from a synthetic resin having a melting point of 180°–300° F.

7. The pivoted door assembly in accordance with claim 1 wherein the diameter of the latch bolt is 50–80 percent of the diameter of said recess in said jamb to allow limited relative motion therebetween upon release by said fusible closure.

8. The pivoted door assembly in accordance with claim 7 wherein latch bolt projects into said recess of said jamb a distance of at least 0.15 inch.

9. The pivoted door assembly in accordance with claim 1 wherein said hinge assembly is a continuous hinge extending along the vertical edge of said door with a pair of leaves having aligned apertures therein aligned with said recesses in said door and jamb.

10. The pivoted door assembly in accordance with claim 9 wherein said housing has an outwardly extending flange at its outer end seated in a counterbore in the door mounted hinge leaf.

11. The pivoted door assembly in accordance with claim 1 wherein said latch bolt assembly includes a bolt receptacle having a tubular body seated in said jamb recess.

12. A fire-retardant pivoted door assembly with heat actuated latching members comprising:

(a) a metal door frame having jambs and a header;

(b) a fire-retardant door;

(c) a hinge assembly along one side of said door pivotally mounting said door on one of said jambs, said hinge assembly having lower temperature resistance than said door and frame; and (d) a multiplicity of heat actuated latch bolt assemblies seated in recesses in said door spaced vertically along said one jamb, each of said assemblies including:

(i) a housing horizontally disposed in said door along its edge on said one side, said housing providing an elongated cavity opening adjacent the edge of said door, said housing having an inwardly extending lip adjacent the outer end of said cavity, said housing also having an outwardly extending flange at its outer end;

(ii) a latch bolt slidably seated in said cavity;

(iii) a spring biasing said latch bolt towards the opening of said cavity; and (iv) a fusible closure extending across said opening of said cavity and retaining said latch bolt therein against the biasing pressure of said spring, said fusible closure being dimensioned and configured cooperatively with said lip so as to be retained thereby, said fusible closure being fabricated from a synthetic resin having a melting point of 180°-300° F., said one jamb having a spaced recess formed therein configured and dimensioned to receive said latch bolt upon release by melting of said fusible closure.

13. The pivoted door assembly in accordance with claim 9 wherein said latch bolt has a circumferential recess along its length and dimensioned to be engageable with said metal jamb upon release into said recess therein.

14. The pivoted door assembly in accordance with claim 9 wherein said spring is a coiled compression spring acting between an inner end wall on said housing and the inner end of said bolt.

15. The pivoted door assembly in accordance with claim 9 wherein the diameter of the latch bolt is 50–80 percent of the diameter of said recess in said jamb to allow limited relative motion therebetween upon release by said fusible closure, said latch bolt being dimensioned to project into said recess of said jamb a distance of at least 0.015 inch.

16. A heat actuated latching assembly for a fire-retardant pivoted door assembly comprising:

(a) a housing adapted to be horizontally disposed in an associated door along its edge, said housing providing an elongated cavity opening at one end thereof, said housing having an inwardly extending lip adjacent said cavity opening, said housing also having an outwardly extending flange about its cavity opening;

(b) a latch bolt slidably seated in said cavity;

(c) means biasing said latch bolt towards the opening of said cavity; and (d) a fusible closure extending across said opening of said cavity and retaining said latch bolt therein against the biasing pressure of said biasing means, said fusible closure being dimensioned and configured cooperatively with said lip so as to be retained thereby, said fusible closure being fabricated from a synthetic resin having a melting point of 180°-300° F.

17. The latch assembly in accordance with claim 16 including a bolt receptacle having a tubular body adapted to seat in a recess in the associated jamb.

18. The latch assembly in accordance with claim 16 wherein said housing has an outwardly extending flange at its outer end.

19. The latch assembly in accordance with claim 16 wherein said latch bolt has a circumferential recess along its length and dimensioned to be engageable with the associated metal jamb upon its release, and wherein said biasing means is a coiled compression spring.

* * * * *